US005705734A

United States Patent [19]

Ahmed

[11] Patent Number: 5,705,734

[45] Date of Patent: Jan. 6, 1998

[54] AUTOMATED BRANCH FLOW CALIBRATION IN A HVAC DISTRIBUTION SYSTEM

[75] Inventor: Osman Ahmed, Buffalo Grove, Ill.

[73] Assignee: Landis & Staefa, Inc., Buffalo Grove, Ill.

[21] Appl. No.: 682,157

[22] Filed: Jul. 17, 1996

[51] Int. Cl.[6] ..... G01F 25/00

[52] U.S. Cl. ..... 73/3; 454/256

[58] Field of Search ..... 73/3; 137/557; 454/256, 255, 340, 238, 61, 59

[56] References Cited

U.S. PATENT DOCUMENTS

| | | | |
|---|---|---|---|
| 155,280 | 9/1874 | Ball et al. | 73/3 |
| 3,640,307 | 2/1972 | Drzala | 137/557 |
| 3,723,987 | 3/1973 | Barone, Jr. et al. | 73/196 X |
| 3,978,707 | 9/1976 | Grove et al. | 73/3 |
| 4,591,093 | 5/1986 | Elliot, Jr. | 73/3 X |
| 4,838,483 | 6/1989 | Nurczyk et al. | 73/3 X |
| 4,995,307 | 2/1991 | Floyd | 454/256 X |
| 5,540,619 | 7/1996 | Ahmed | 454/256 |

FOREIGN PATENT DOCUMENTS

| | | | |
|---|---|---|---|
| WO 93/06441 | 4/1993 | European Pat. Off. | 73/3 |

OTHER PUBLICATIONS

Portions of *1993 Fundamentals Handbook*, "Duct Design", 1993, Chapter 32, pp. 1–7, 10–11.

*Primary Examiner*—George M. Dombroske
*Assistant Examiner*—Paul D. Amrozowicz
*Attorney, Agent, or Firm*—Greer, Burns & Crain, Ltd.

[57] ABSTRACT

A HVAC system automates the process of calibrating the individual branch flows of the system. For each branch of the system, a damper is closed and flow values at the output of the prime mover and at the input of the damper are measured. The damper is then opened 50% and again flow values at the output of the prime mover and at the input of the damper are measured. A flow coefficient, which correlates the flow difference measured at the output of the prime mover with the flow difference measured at the input of the damper, is then determined. The flow through each damper of each branch is calibrated in this manner, resulting in an overall balancing of the HVAC system. The automated process of branch flow calibration eliminates the tedious and time consuming process of both manual steps of measuring the branch flows and determining the flow coefficients as was performed in the prior art.

15 Claims, 4 Drawing Sheets

AUTOMATED BRANCH FLOW CALIBRATION IN A HVAC DISTRIBUTION SYSTEM

FIELD OF THE INVENTION

This invention is generally related to control systems, and more particularly to calibration of branch fluid flows in heating, ventilation, and air-conditioning (HVAC) fluid distribution systems.

BACKGROUND OF THE INVENTION

Fluid distribution systems are well known in the art. One example of a fluid distribution system is the system associated with heating, ventilating and air-conditioning (HVAC) distribution systems. HVAC distribution systems see widespread use in commercial applications, i.e., residential housing, apartment buildings, office buildings, etc. However, HVAC distribution systems also see widespread use in laboratory-type settings. In this implementation, the HVAC system is primarily intended to exhaust potentially noxious fumes, etc.

In a majority of HVAC distribution system implementations, the primary goal is to produce and distribute thermal energy in order to provide the cooling and heating needs of a particular installation. For purposes of analysis, the distribution system can be divided into two subsystems; global and local subsystems. The global subsystem consists of a primary mover (i.e., a source) which might be a fan in an air distribution system or a pump in a water distribution system. Also included in the global subsystem is the duct-work required to connect the global subsystem to the local subsystem. The local subsystem primarily consists of dampers or valves in air or water distribution systems, respectively.

A typical HVAC air distribution system consists of a fan, ductwork and local terminal units to meet the cooling/heating need spaces. The fan transfers the electrical energy to the air for the purpose of moving air through the ductwork, the ductwork works as a media to convey the air and the local terminal units provide flow control in response to the space thermal need.

The local terminal unit consists of a controller, damper, actuator and a flow sensor. The controller receives the signal from the flow sensor and determines measured flow. The controller then compares the actual flow with the desired flow or flow setpoint and then modulates the actuator of the damper to ensure that the actual flow is equal to the flow setpoint.

The distribution system described above is common in both variable air volume (VAV) and constant air volume (CAV) HVAC systems. In a VAV system, the required flow through the terminal unit changes to satisfy the varying need of space thermal requirement. As a result, the controller adjusts the damper/actuator to satisfy the dynamic flow requirement. In case of a CAV, the flow requirement remains constant. However, the actual flow may change due to the variation in duct static pressure. Therefore, again the controller has to adjust the damper/actuator position to keep the measured flow constant and equal to the desired flow setpoint.

FIG. 1 generally depicts a prior art HVAC distribution system which has a fan controller 10 which controls the variable air volume by controlling the speed of a fan 12 so that a constant static pressure at an arbitrary duct location (for example, location 14) is maintained. A damper 16 is controlled by a local controller 18. The static pressure at the location 14 measured by a static pressure sensor 20 fluctuates as the flow requirement of the damper 16 varies.

However, the fan controller 10 ignores the requirement of static pressure in the entire system so that the flow requirement of the damper 16 can be satisfied. In this scenario, the fan controller 10 attempts to maintain an arbitrarily selected pressure setpoint, which is often set based on a maximum operating design condition.

With regard to the cost of commissioning, it is felt not only by the HVAC contractor who is performing the commissioning, but also by the control system provider. The current process of commissioning a HVAC system is both tedious and labor intensive, which consequently leads to considerable cost to the building owner and significant time wasted by the contractor and/or the control system provider.

Each section of a structure served by a single fan is called a branch. A branch may be the duct work in the ceiling of a building, for example. In most installations, a single fan serves several branches. The current process of commissioning a HVAC system requires that each branch be individually calibrated so that the entire system can eventually be "balanced."

Branches in the system require calibration because the control signal issued by a local controller to control the damper may not necessarily correspond to an expected amount of flow through the damper. This occurs since the flows that occur throughout the entire system are dependent on the installation and system configuration itself. Consequently, to accurately provide the required amount of flow to particular areas serviced by particular branches, each of the branches must be individually calibrated.

The calibration process for each branch of the system is tedious and time consuming. First, an installation contractor has to have access to the branch at, or substantially near, the damper where flow is to be calibrated. This may present a problem if the damper is located in a tight corner, or other confined area, for example. Then, using an external flow measurement device, the contractor measures the flow through the branch for varying damper positions. The local controller (if applicable) can be used to vary the damper position.

Once the contractor has performed the manual measurements, a flow coefficient is determined. The flow coefficient correlates the manual flow measurements to flows measured by a flow sensor near the damper. The flow coefficient is then entered manually into the local controller so that the local controller can provide adequate flow for the area to be serviced by the branch. The process is then repeated for each and every branch in the system.

The problems of the current method are magnified both during and after installation. For example, the process must be repeated to diagnose whether the system was properly commissioned in the first place. Also, the system may be changed by adding or removing branches as required by the building owner. As the system changes, the flow coefficients for a particular flow sensor and a particular branch may change, which significantly impacts the overall system performance. Only after the HVAC system is re-commissioned are these changes detected. Since the commissioning of a HVAC system is cumbersome to begin with, changes throughout the system may go undetected for quite some time.

Thus, a need exists for a HVAC system which does not require any input from an installation contractor to balance the system, and is thus capable of performing a self-commissioning process so that the cumbersome task of commissioning a HVAC system is eliminated.

SUMMARY OF THE INVENTION

It is therefore an object of the present invention to provide an improved system for commissioning a HVAC distribution system.

Another object of the present invention is to provide an improved system which allows a data communication between a local controller and a source controller to implement automatic HVAC system commissioning.

A related object of the present invention is to provide an improved system which allows a source controller to orchestrate the calibration of branch flows without the requirement of manual measurements and determination of calibration information.

These and other objects will become apparent upon reading the following detailed description of the preferred embodiment of the present invention, while referring to the attached drawings.

DETAILED DESCRIPTION OF A PREFERRED EMBODIMENT

Figure 1:
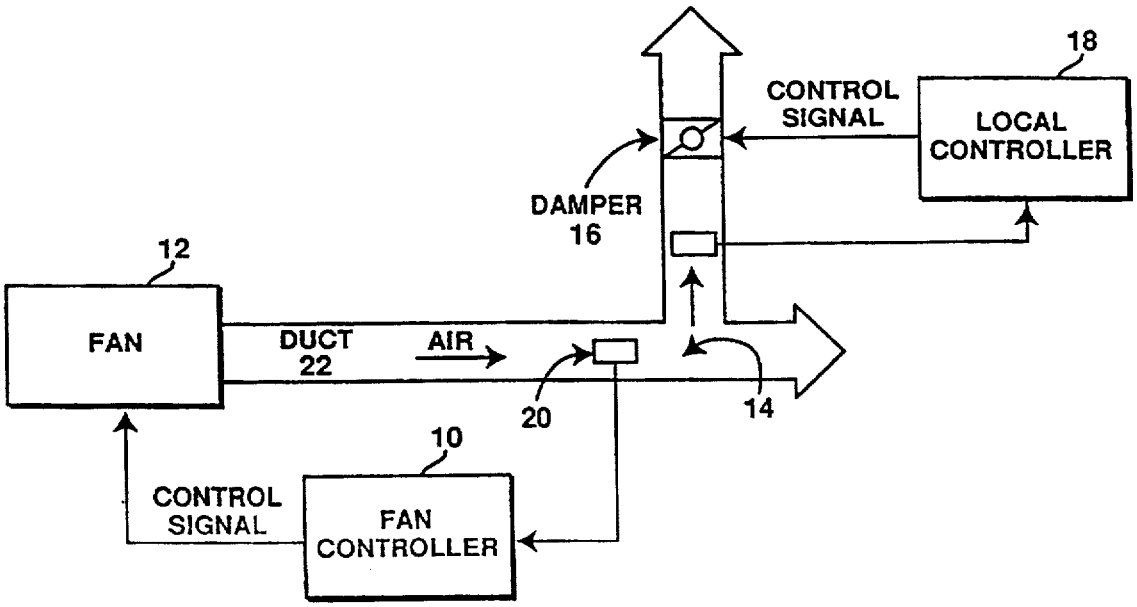
FIG. 1 (PRIOR ART)
FIG. 1 generally depicts, in block diagram form, a prior art control system implemented in a HVAC system.

Typically in prior art distribution systems there is a flow sensor which consists of a pressure differential measuring device and a transducer to convert the pressure signal into an electrical signal. The controller then converts the electrical signal back to the differential pressure value and then applies the following equation to determine the velocity measured at the location of the flow sensor.

$$P_v = C*(V/4005)^{2.0} \quad (A)$$

where, $P_v$ is the measured velocity pressure, V is velocity, 4005 is a constant for standard air and C is a flow coefficient.

In an ideal case, where $P_v$ corresponds perfectly to the velocity, C will be unity. However, in actual practice C varies with the type of sensor, its installation and location among other factors. Manufacturers of such flow sensors often use a higher C to amplify the pressure signal.

The current practice in HVAC industry is to measure total flow from the terminal unit by an independent flow sensing device. Once that flow is measured independently, C can be calculated by inserting the flow into equation A and using corresponding value of $P_v$. The device that is used is known as a flowhood, and the process of measuring independent flow and then calculating the flow coefficients is a part of HVAC system balancing, which is usually carried out by the balancing contractors.

Although it appears to be a simple method, the measurement of flow using such flowhoods and manual calculation to enter flow coefficient values is a tedious and labor intensive process that is expensive for building owners. Furthermore, the use for a HVAC controls company to coordinate with the balancing contractor in a timely fashion becomes a logistics problem which often complicates the commissioning process and is expensive for the controls contractor. It is not unusual for problems to arise in determining responsibility for operational problems as being caused by improper balancing or the control system. Also, as a system changes over time, the calibration coefficients for control flow sensors may change which will affect the overall system performance. This may happen due to changes in the ductwork, the relocation of terminal units and the like. Such changes may not be detected until the process of determining flow coefficients is repeated.

There are two embodiments of the system of the present invention, neither of which requires any input from a balancing contractor. If an operator requests system calibration, the data for calibration of flow sensors will be collected remotely over the network, calibration coefficients will be calculated and sent to the local controllers, all automatically. The invention can be used during commissioning and afterwards anytime if it is necessary. The on-line capability of flow verification as part of the existing control system will also benefit the user. The system can also be utilized for ventilation verification and fault diagnostics in addition to ensuring that the control system is operating properly. The invention eliminates the need for flow hoods used by the balancing contractor in the balancing process.

Both embodiments determine the flow coefficients in the system. For most common applications in commercial buildings, the first embodiment is preferred. The second embodiment is suitable for more demanding applications where periodic calibration is needed, such as in laboratories, clean rooms, operating rooms covering healthcare, pharmaceutical, academic and research facilities.

Figure 2:
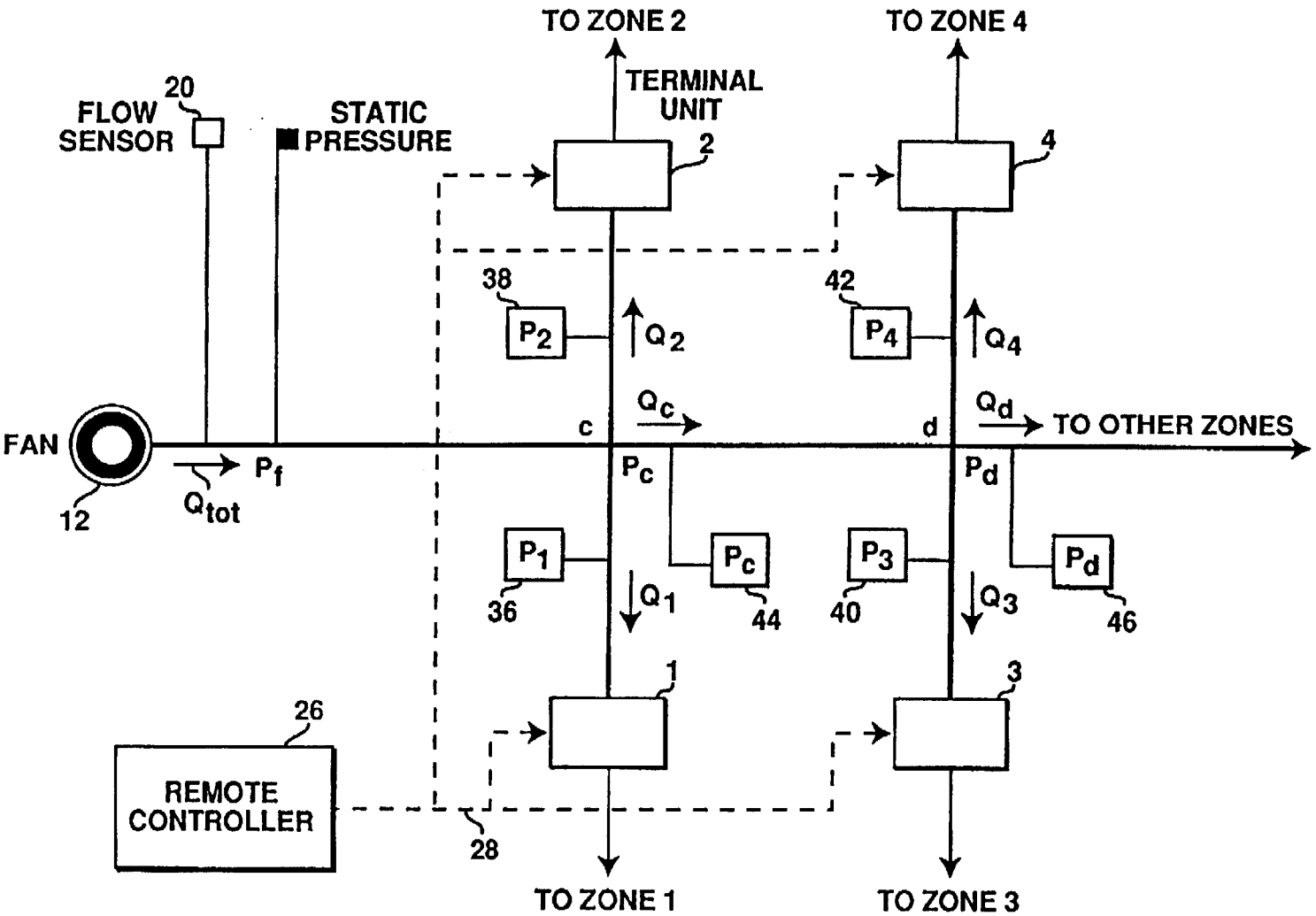
FIG. 2 depicts, in block diagram form, one embodiment of a HVAC system for automatically balancing system flows in accordance with the present invention.

In accordance with the first embodiment of the present invention and referring to FIG. 2, the flow sensor 20 at the fan outlet will be used as an independent source of measuring flow at each terminal unit 1, 2, 3, 4 by applying following process.

Terminal units usually have factory default flow coefficients provided with the units. The default values, although perhaps incorrect, can be used initially to maintain a constant flow through each terminal unit by fixing a flow set point and using proportion-integral-derivative (PID) control if the flow through each terminal unit is held constant, the total system flow, $Q_{tot}$, measured at the fan outlet will be constant. Every time $Q_{tot}$ is measured, sufficient time should be allowed for the system to become steady. Initially, the terminal unit flow setpoints can be arbitrarily selected as mid-point between minimum and maximum values of respective terminal unit.

At this point, terminal unit 1 can be commanded to be shut off to ensure $Q_1$ is zero. This can be done by providing a control signal corresponding to the closed damper position from a remote controller 26 over a network 28. The $Q_{tot}$ should be measured at this point. The terminal unit 1 will then be commanded to open to 50% or 100%. The $Q_{tot}$ should be measured again at steady state and also the $P_v$ sensor 36 signal for terminal unit 1 should be recorded. It should be understood that there are other terminal units 2, 3 and 4 for rooms 2, 3 and 4, respectively, and that velocity pressure sensors 36, 38, 40 and 42 are provided for rooms 1–4, respectively. Also pressure sensors 44 and 46 are provided in the ducts as shown. The difference in flow $Q_{tot}$ between the previous and current value should be equal to the flow $Q_1$. This is true since the flow through the other terminal units have not changed and kept constant to their previous values. Therefore, the flow sensor 36 for the damper of terminal unit 1 can be calibrated using Equation A by using $P_f$ of the fan and corresponding $P_1$ for terminal unit 1.

The above procedure can be progressively used to calculate the coefficients of flow sensors for each of the other terminal units 2, 3 and 4. The whole process can be automated once the user at the remote controller 26 initiates the process. The flow sensor 20 mounted at the outlet of the fan needs to be fairly accurate, precalibrated and the local terminal units should have low leakage rate at the rated working pressure.

The above procedure works well for a small system where the change in flow due to the closing of an individual terminal unit is detectable and possible to measure by the total flow sensor. A rule of thumb is that the total number of terminal units should be about 10 or fewer.

Figure 3:
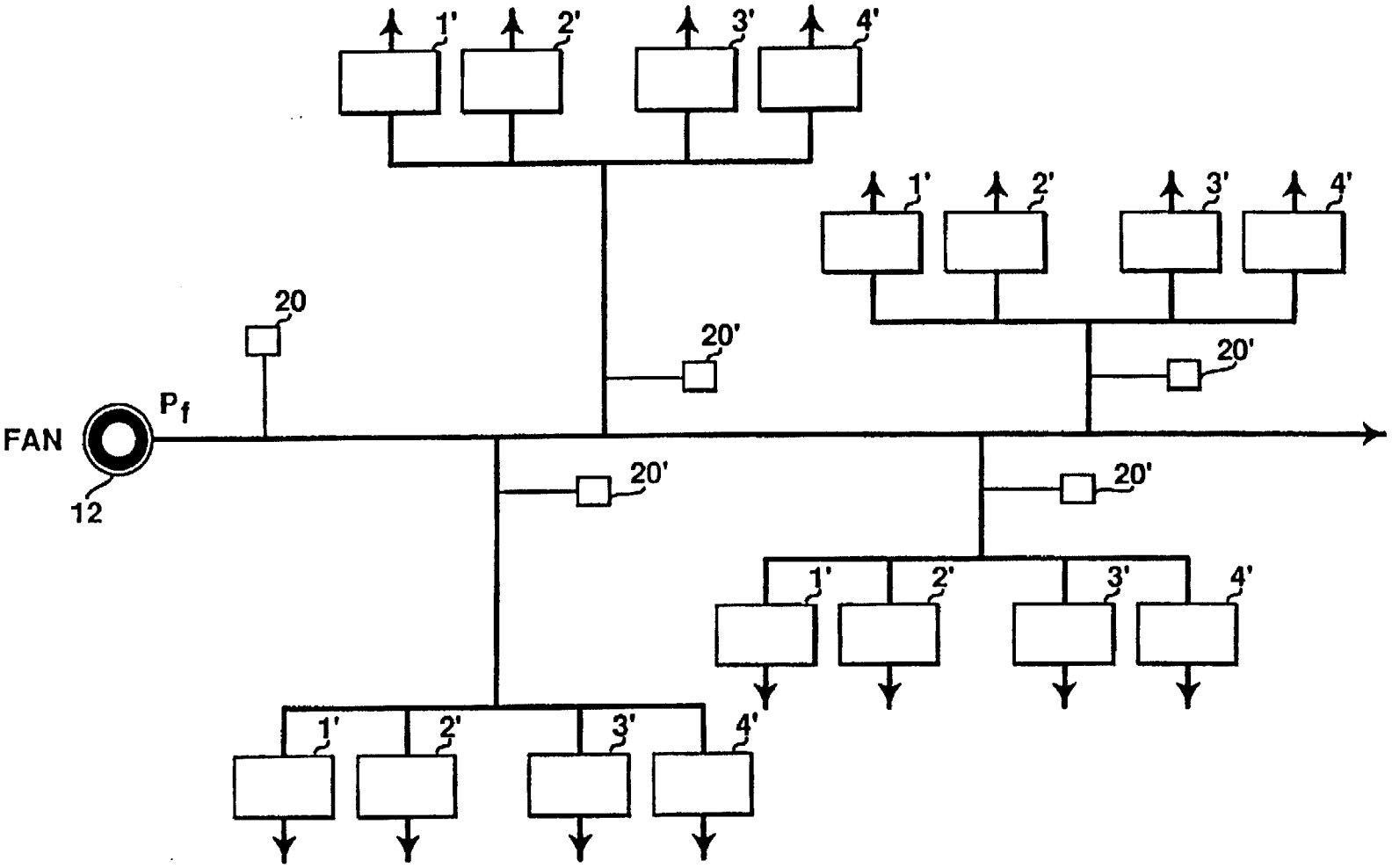
FIG. 3 depicts, in block diagram form, a multiple zone HVAC system for automatically balancing system flows in accordance with the present invention; and, FIG. 4 depicts, in block diagram form, an alternative embodiment of a HVAC system for automatically balancing system flows in accordance with the present invention.

This embodiment is also applicable for a large system by dividing the distribution system into several zones. In such case and referring to FIG. 3, a flow sensor 20' can be mounted for each zone such that the flow coefficients for the terminal units in a particular zone can be calculated with the help of a zone flow sensor 20'. As a cost reduction, instead of having a permanent zone flow sensor for each zone, it may be desired to only have a permanent flow sensor housing with an access door. When they need to be used, the zone flow sensors can be inserted one zone at a time to complete the flow coefficients calculation for each of zone terminal units.

Figure 4:
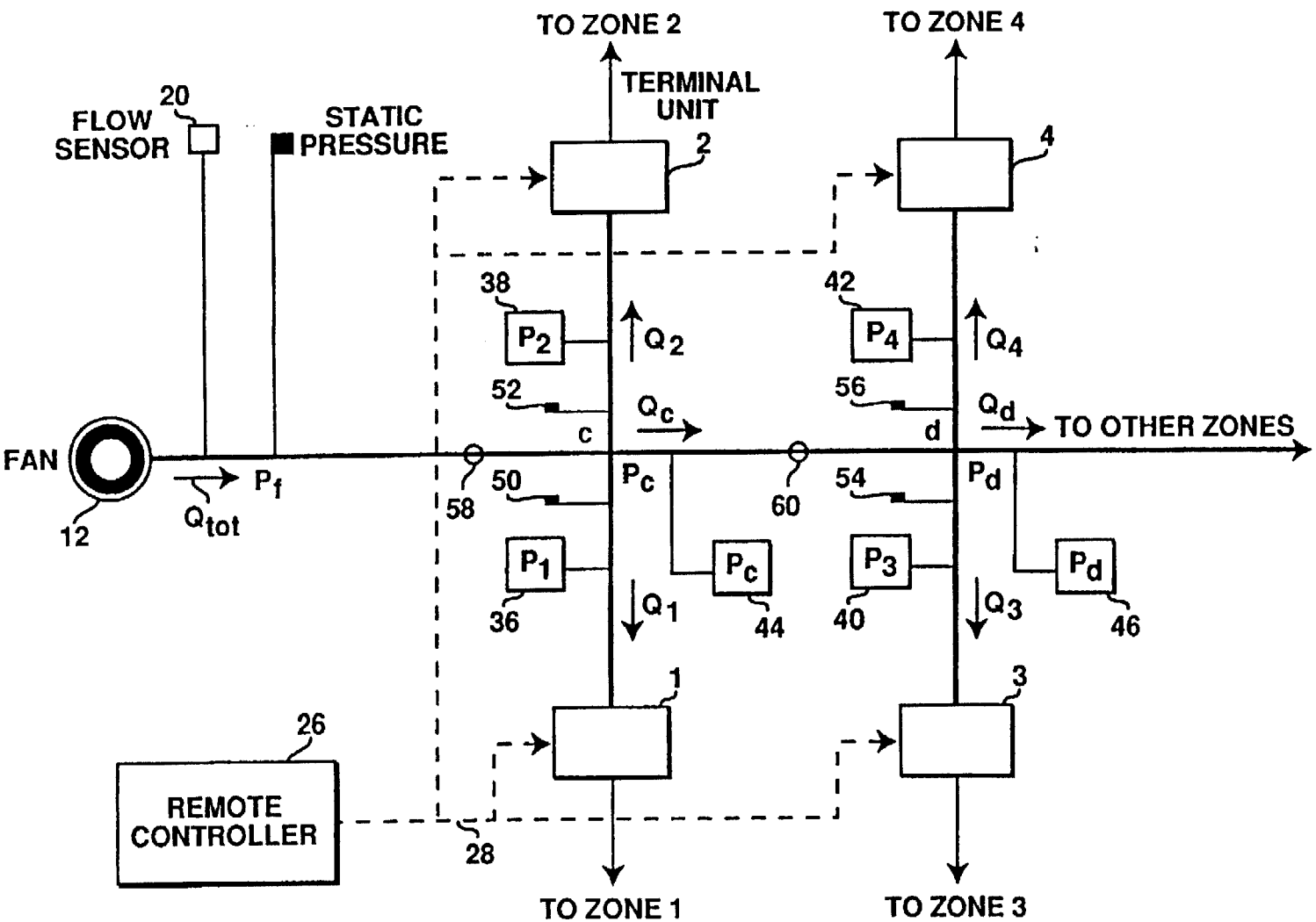

The second embodiment is applicable when static pressure sensors are available during the commissioning phase at the inlet of each terminal unit. This is shown in FIG. 4 which is similar to FIG. 2 and has the same reference numbers for the same components and in addition has static pressure sensors 50, 52, 54 and 56 located as shown.

The fundamental laws of pressure drop between any two points in a duct has two components, frictional and local loss due to the pipe fittings. The frictional loss can be expressed as $$\Delta P_F = f(12L/D_h)(V/4005)^{2.0} \tag{1}$$

where f is a friction factor, L is length of the duct (ft) and $D_h$ is the duct hydraulic diameter (in).

The hydraulic diameter, $D_h$ is defined as the ratio between the flow area and perimeter. For a round duct, $D_h$ becomes the duct diameter, d, and for a rectangular duct, $D_h$ is (W1*W2/(2*(W1+W2))), where W1 and W2 are the two sides of a rectangle.

The friction factor f is a function of duct velocity V, L, $D_h$ and duct roughness, E. The range of values for duct roughness is narrow and will seldom vary from one section of the duct to another. The friction factor can be explicitly calculated by knowing the duct parameters and as a function of velocity as follows:

$$f = 0.11\left(\frac{E}{Dh} + \frac{68}{Re}\right)^{0.25} \tag{2}$$

where the Reynolds number, Re is expressed as $$Re = \frac{DhV}{720\,Nu} \tag{3}$$

where Nu is the kinematics viscosity of air. For standard air, Re=8.5*V*$D_h$. If f'≧0.018, then f=f. Otherwise f=0.85 f'+0.0028.

The second component of duct pressure loss is due to the duct fittings which is known as local loss and expressed as $$\Delta P_1 = K^*(V)^{2.0} \tag{4}$$

Hence, between any two points in a duct system, the pressure drop can be expressed as $$\Delta P = \Delta P_F + \Delta P_1 \tag{5}$$

For a given duct section, hydraulic diameter, $D_h$, length, L and roughness factor remain constant. Hence $\Delta P_t$ can be expressed as $$\Delta P_t = \left[\left(K_{f1} + \frac{K_{f2}}{V}\right)^{0.25} + K_1\right] V^{2.0} \tag{6}$$

where $K_{f1}$, $K_{f2}$ are frictional constants and $K_1$ is the local loss coefficient. However, the variation with the magnitude of frictional term $(K_{f1}+K_{f2}/V)^{0.25}$ for a range of duct velocity, V is very small. So for all practical purposes it can be assumed as a constant. Hence, $$\Delta P_t = K_{eq}(V)^{2.0} \tag{7}$$

Since V=Q/A, the equation (7) becomes $$\Delta P_t = K(Q)^{2.0} \tag{8}$$

There are two approaches to obtain the value of K for each duct segment. When design data and calculations are available for a duct system (i.e., duct length, diameter, roughness factor, the local loss coefficients), an estimate of $K_{f1}$, $K_{f2}$ and $K_1$ can be made and used in Equation (6). Design data and calculations are available for new construction from consulting engineers. In absence of design data, all coefficients are lumped into one single parameter, K for each duct segment. Actual measured values of pressures will be used to compute K. Measured values can be also used to update or validate the coefficients obtained from the design data.

With respect to the process of calculating the duct pressure loss coefficients for various segments in the main duct and subsequently the procedure of determining flow coefficients, it will be described in connection with FIG. 4. The duct pressure loss between point f (fan outlet where pressure is measured) and inlet to the terminal unit 1 where static pressure $P_1$ is measured by sensor 50 can be written as $$P_f - P_1 = K_{fc}(V_{fc})^2 + K_{cl}(V_{cl})^2 \tag{9}$$

In the above equation, $V_{fc}$ is the total measured fan flow and $V_{cl}$ is the unknown flow through the terminal unit. As explained in connection with the first embodiment, the unknown flow can be kept constant through the terminal unit 1 by using the default flow coefficient and using terminal unit control loop.

Keeping the terminal unit 1 flow constant, the fan flow can be varied by commanding other terminal units to open or close. Hence, two sets of measured values of $P_f$, $P_1$ and $V_{fc}$ can be obtained and expressed as follows:

$$(P_f - P_1)|_1 = K_{fc}(V_{fc1})^2 + K_{cl}(V_{cl1})^2 \tag{10}$$

and $$(P_f - P_1)|_2 = K_{fc}(V_{fc2})^2 + K_{cl}(V_{cl2})^2 \tag{11}$$

By taking the difference between Equations 10 and 11, and noting that the velocity through the terminal unit, $V_{cl}$, remains constant, the coefficient for the main duct segment identified at 58, can be calculated as, $$K_{fc} = \frac{(P_f - P_1)|_1 - (P_f - P_1)|_2}{(V_{fc1})^2 - (V_{fc2})^2} \tag{12}$$

The similar process can be adapted to calculate coefficients for other main duct segments such as segment 60. Once the main segments are calibrated, the next step will calculate each terminal flow as follows:

1. For terminal unit 1, for example, command terminal units 2, 3, and 4 to close completely. In that case, $P_c=P_2$ and $P_d=P_3=P_4$.
2. Leave the terminal unit 1 at any open position (preferably at 50%).
3. Calculate the velocity through the first main duct segment as $$V_{fc}=\left(\frac{P_f-P_c}{K_{fc}}\right)^{0.5} \tag{13}$$

Hence, the flow rate through the first segment 58 is known as $$Q_{fc}=V_{fc}*A_{fc} \tag{14}$$

Similarly, the velocity through the second main segment 60 is $$V_{cd}=\left(\frac{P_c-P_d}{K_{cd}}\right)^{0.5} \tag{15}$$

and the flow rate through that segment 60 becomes $$Q_{cd}=V_{cd}*A_{cd} \tag{16}$$

The difference between the two values of must be equal to the flow through the terminal unit 1. Hence, the flow coefficient may be fine-tuned by simple field adjustments. The same process can be adapted to sequentially determine the flow coefficients for each of the other boxes.

While various embodiments of the present invention have been shown and described, it should be understood that various alternatives, substitutions and equivalents can be used, and the present invention should only be limited by the claims and equivalents of the claims.

Various features of the present invention are set forth in the following claims.

What is claimed is:

1. An apparatus for automatically calibrating the fluid flow in at least one branch of a fluid distribution system, the fluid distribution system implementing a local control component in the at least one branch, the fluid distribution system having a source component for distributing the fluid to the at least one branch, said apparatus comprising:

means for selectively instructing the local control component to at least first and second positions;

first means for measuring a first and second fluid flow at an output of the source component, said first and second fluid flow at said output of the source component corresponding to said first and second positions of said local control component;

second means for measuring a first and second fluid flow at an input of the local control component, said first and second fluid flow at said input of the local control component corresponding to said first and second positions of said local control component; and means for calibrating the fluid flow in the at least one branch of the fluid distribution system based on the measured first and second fluid flow at said output of the source component and the measured first and second fluid flow at said input of the local control component.

2. The apparatus of claim 1 wherein said means for instructing the local control component further comprises a source controller coupled to said first means for measuring.

3. The apparatus of claim 2 wherein said source controller instructs the local control component via a local controller.

4. The apparatus of claim 2 further comprising means for transferring said measured first and second fluid flow at an input of the local control component to said source controller.

5. The apparatus of claim 4 wherein said means for calibrating the fluid distribution system further comprises said source controller.

6. An apparatus for automatically calibrating air flow in at least one branch of a heating, ventilation and air-conditioning (HVAC) distribution system, the HVAC distribution system implementing a damper means in the at least one branch of the HVAC distribution system, the damper means being adjustable to a plurality of positions, the HVAC distribution system having a fan for distributing the air to the at least one branch, the apparatus comprising:

means for selectively controlling the damper means to first and second positions;

a first flow sensor for measuring a first and second air flow at an output of the fan, said first and second air flow at said output of the fan corresponding to said first and second positions of said damper means;

a second flow sensor for measuring a first and second air flow at an input of the damper means, said first and second air flow at said input of the damper means corresponding to said first and second positions of said damper means; and means for calibrating the air flow in the at least one branch of the HVAC distribution system based on the measured first and second air flow at said output of the fan and the measured first and second air flow at said input of the damper means.

7. The apparatus of claim 6 wherein said means for calibrating further comprises either a local controller or a source controller.

8. A method of automatically calibrating the fluid flow in at least one branch of a fluid distribution system, the fluid distribution system implementing a local control component in the at least one branch of the fluid distribution system, the local control component being adjustable to a plurality of positions, the fluid distribution system having a source component for distributing the fluid to the at least one branch, the method comprising the steps of:

(a) instructing the local control component to first and second positions;

(b) measuring a first and second steady state fluid flow at an output of the source component, said first and second steady state fluid flow at said output of the source component corresponding to said first and second positions of said local control component;

(c) measuring a first and second steady state fluid flow at an input of the local control component, said first and second steady state fluid flow at said input of the local control component corresponding to said first and second positions of said local control component; and (d) calibrating the fluid flow in the at least one branch of the fluid distribution system based on the measured first and second steady state fluid flow at said output of the source component and the measured first and second steady state fluid flow at said input of the local control component.

9. The method of claim 8, wherein the steps (a) through (d) are repeated for each branch of the fluid distribution system.

10. A method of automatically calibrating the fluid flow in at least a first branch of a fluid distribution system of the type which has a first main duct segment between a source component for supplying fluid in said system and said first branch and a second main duct segment downstream of said first main duct segment and said first branch, and additional branches downstream of said first main duct segment, said system having a local control component in each said branch of the fluid distribution system, each local control component being adjustable to a plurality of positions, the method comprising the steps of:

determining the flow coefficient for said first main duct segment by measuring the static pressure in said main duct segment and at said first branch at two different operating conditions, comprising different flow rates in said first main duct segment while keeping the flow rate through said first branch constant, and calculating the flow coefficient of said first main duct segment;

determining the flow coefficient for said second main duct segment by measuring the static pressure at said source component and at said first branch at said two different operating conditions;

setting said first branch local control component at a first predetermined open position while closing all other branch local control components, and calculating the velocity through the first main duct segment;

calculating the flow rate through said first main duct segment;

calculating the velocity through the second main duct segment;

calculating the flow rate through said second main duct segment;

subtracting the flow rate of said second main duct segment from the flow rate of said first main duct segment to determine the flow rate through said first branch.

11. A method as defined in claim 10 wherein said step of calculating the velocity through said first main duct segment is done using the equation:

$$V_{fc} = \left( \frac{P_f - P_c}{K_{fc}} \right)^{0.5}.$$

12. A method as defined in claim 10 wherein said step of calculating the flow rate through said first main duct segment is done using the equation:

$$Q_{fc} = V_{fc} * A_{fc}.$$

13. A method as defined in claim 10 wherein said step of calculating the velocity through said second main duct segment is done using the equation:

$$V_{cd} = \left( \frac{P_c - P_d}{K_{cd}} \right)^{0.5}.$$

14. A method as defined in claim 10 wherein said step of calculating the flow rate through said second main duct segment is done using the equation:

$$Q_{cd} = V_{cd} * A_{cd}.$$

15. A method of automatically calibrating the fluid flow in at least a first branch of a fluid distribution system of the type which has a first main duct segment between a source component for supplying fluid in said system and said first branch and a second main duct segment downstream of said first main duct segment and said first branch, and additional branches downstream of said first main duct segment, said system having a local control component in each said branch of the fluid distribution system, each local control component being adjustable to a plurality of positions, the method comprising the steps of:

determining the flow coefficient for said first main duct segment by measuring the static pressure in said main duct segment and at said first branch at two different operating conditions, comprising different flow rates in said first main duct segment while keeping the flow rate through said first branch constant, and calculating the flow coefficient of said first main duct segment using the equation:

$$K_{fc} = \frac{(P_f - P_1)|_1 - (P_f - P_1)|_2}{(V_{fc1})^2 - (V_{fc2})^2}$$

determining the flow coefficient for said second main duct segment by measuring the static pressure at said source component and at said first branch at two different operating conditions, comprising different flow rates in said second main duct segment while keeping the flow rate through said first branch constant, and calculating the flow coefficient of said second main duct segment using the equation:

$$K_{cd} = \frac{(P_f - P_1)|_1 - (P_f - P_1)|_2}{(V_{cd1})^2 - (V_{cd2})^2}$$

setting said first branch local control component at a first predetermined open position while closing all other branch local control components, and calculating the velocity through the first main duct segment using the equation:

$$V_{fc} = \left( \frac{P_f - P_c}{K_{fc}} \right)^{0.5}$$

calculating the flow rate through said first main duct segment using the equation:

$$Q_{fc} = V_{fc} * A_{fc}$$

calculating the velocity through the second main duct segment using the equation:

$$V_{cd} = \left( \frac{P_c - P_d}{K_{cd}} \right)^{0.5}$$

calculating the flow rate through said second main duct segment using the equation:

$$Q_{cd} = V_{cd} * A_{cd}$$

subtracting the flow rate of said second main duct segment from the flow rate of said first main duct segment to determine the flow rate through said first branch.

* * * * *

UNITED STATES PATENT AND TRADEMARK OFFICE

CERTIFICATE OF CORRECTION

PATENT NO. : 5,705,734
DATED : January 6, 1998
INVENTOR(S) : Osman Ahmed

It is certified that error appears in the above-identified patent and that said Letters Patent is hereby corrected as shown below:

Column 5, line 50, delete "$Re=8.5*V*D_n$."

and insert --$Re=8.56*V*D_h$.-- therefor

Column 5, line 63, delete "$\Delta P$" and insert

--$\Delta p_t$-- therefor

Signed and Sealed this

First Day of September, 1998

Bruce Lehman

*Attest:*

BRUCE LEHMAN

*Commissioner of Patents and Trademarks*

*Attesting Officer*